US008302252B2

(12) United States Patent
Hyun et al.

(10) Patent No.: US 8,302,252 B2
(45) Date of Patent: Nov. 6, 2012

(54) DUST SEPARATING APPARATUS OF VACUUM CLEANER

(75) Inventors: Kie-Tak Hyun, Changwon (KR); Kyeong-Seon Jeong, Changwon (KR); Jin-Hyouk Shin, Changwon (KR); Seong-Koo Cho, Changwon (KR); Geun-Bae Hwang, Changwon (KR)

(73) Assignee: LG Electronics Inc., Seoul (KR)

( * ) Notice: Subject to any disclaimer, the term of this patent is extended or adjusted under 35 U.S.C. 154(b) by 479 days.

(21) Appl. No.: 12/407,544

(22) Filed: Mar. 19, 2009

(65) Prior Publication Data

US 2009/0178232 A1 Jul. 16, 2009

Related U.S. Application Data

(63) Continuation of application No. PCT/KR2008/001947, filed on Apr. 7, 2008.

(30) Foreign Application Priority Data

Jul. 5, 2007 (KR) ..... 10-2007-0043974

(51) Int. Cl.
*A47L 9/10* (2006.01)

(52) U.S. Cl. ..... 15/347; 15/300.1

(58) Field of Classification Search ..... 15/300.1, 15/347

See application file for complete search history.

(56) References Cited

U.S. PATENT DOCUMENTS 447,333 A * 3/1891 Kutsche ..... 55/349
3,505,703 A 4/1970 Miller et al.
3,744,220 A 7/1973 Klein
6,332,239 B1 12/2001 Dubos et al.
6,350,292 B1 * 2/2002 Lee et al. ..... 55/459.1
6,436,160 B1 8/2002 Stephens et al.
6,572,668 B1 * 6/2003 An et al. ..... 55/428
6,613,129 B2 9/2003 Gen
6,679,930 B1 1/2004 An et al.
6,810,558 B2 11/2004 Lee
7,419,521 B2 9/2008 Oh et al.

(Continued)

FOREIGN PATENT DOCUMENTS

CN 1347294 A 5/2002

(Continued)

OTHER PUBLICATIONS

O'Doherty et al., "The use of tangential offtakes for energy savings in process industries", Proceedings of the Institution of Mechanical Engineers, Part E: Journal of Process Mechanical Engineering, vol. 206, Jan. 1, 1992, pp. 99-109, XP000866500.

*Primary Examiner* — Lee D Wilson
*Assistant Examiner* — Shantese McDonald
(74) *Attorney, Agent, or Firm* — Birch, Stewart, Kolasch & Birch, LLP

(57) ABSTRACT

A dust separator for a vacuum cleaner including a body having a pair of spaced apart ends, a first air inlet formed in the body and being configured to receive an air flow containing dust, and a dust outlet formed inwardly of the spaced apart ends and apart from the first air inlet to discharge dust separated in the body, is provided. In addition, a cross-sectional area of the body at the dust outlet is greater than a cross-sectional area of the body at the first air inlet.

22 Claims, 11 Drawing Sheets

U.S. PATENT DOCUMENTS

| | | | | |
|---|---|---|---|---|
| 7,479,173 | B2 * | 1/2009 | Ivarsson et al. | 55/349 |
| 7,488,362 | B2 | 2/2009 | Jeong et al. | |
| 7,534,279 | B2 | 5/2009 | Oh et al. | |
| 7,628,833 | B2 | 12/2009 | Oh | |
| 7,686,861 | B2 | 3/2010 | Oh | |
| 7,854,782 | B2 | 12/2010 | Oh et al. | |
| 2002/0134059 | A1 | 9/2002 | Oh | |
| 2005/0138759 | A1 | 6/2005 | Park et al. | |
| 2005/0138763 | A1 | 6/2005 | Tanner et al. | |
| 2005/0229554 | A1 | 10/2005 | Oh et al. | |
| 2005/0252179 | A1 | 11/2005 | Oh et al. | |
| 2006/0075728 | A1 | 4/2006 | Oh et al. | |
| 2006/0107630 | A1 | 5/2006 | Ivarsson et al. | |
| 2006/0117725 | A1 | 6/2006 | Oh et al. | |
| 2007/0011997 | A1 | 1/2007 | Han et al. | |
| 2007/0079585 | A1 | 4/2007 | Oh et al. | |
| 2007/0143953 | A1 | 6/2007 | Hwang et al. | |
| 2009/0056290 | A1 | 3/2009 | Oh et al. | |
| 2009/0293224 | A1 | 12/2009 | Hyun et al. | |
| 2010/0043170 | A1 | 2/2010 | Ni | |

FOREIGN PATENT DOCUMENTS

| | | | |
|---|---|---|---|
| CN | 1353591 | A | 6/2002 |
| DE | 3936078 | A1 | 5/1991 |
| DE | 19920237 | A1 | 5/2000 |
| DE | 10 2004 030 350 | A1 | 1/2006 |
| DE | 20 2006 016 366 | U1 | 3/2007 |
| EP | 0996355 | B1 | 8/2004 |
| EP | 1547509 | A2 | 6/2005 |
| GB | 2360719 | A | 10/2001 |
| GB | 2 417 916 | A | 3/2006 |
| JP | 52-138367 | | 11/1977 |
| JP | 2003-139094 | A | 5/2003 |
| JP | 2004-135700 | A | 5/2004 |
| JP | 2004-174206 | A | 6/2004 |
| JP | 2005-040257 | A | 2/2005 |
| JP | 2005-324002 | A | 11/2005 |
| JP | 2005-342334 | A | 12/2005 |
| JP | 2006-130119 | A | 5/2006 |
| KR | 10-2000-0056656 | A | 9/2000 |
| KR | 10-2002-0078798 | A | 10/2002 |
| KR | 10-2005-0100913 | A | 10/2005 |
| KR | 10-2006-0030255 | A | 4/2006 |
| KR | 10-2006-0061493 | A | 6/2006 |
| KR | 10-0623916 | B1 | 9/2006 |
| KR | 10-2006-0105390 | A | 10/2006 |
| RU | 2240716 | C2 | 2/2000 |
| RU | 2281683 | C2 | 8/2006 |
| RU | 2286079 | C2 | 10/2006 |
| RU | 2288628 | C1 | 12/2006 |
| WO | WO 00/49933 | A1 | 8/2000 |
| WO | WO 00/64321 | A1 | 11/2000 |
| WO | WO 00/74548 | A1 | 12/2000 |
| WO | WO 2006/026414 | A2 | 3/2006 |
| WO | WO 2006/125945 | A1 | 11/2006 |
| WO | WO 2007/120535 | A2 | 10/2007 |

* cited by examiner

DUST SEPARATING APPARATUS OF VACUUM CLEANER

CROSS-REFERENCE TO RELATED APPLICATIONS

This application is a continuation of prior International Application No. PCT/KR2008/001947, filed Apr. 7, 2008, which claims priority to Korean Patent Application No. 10-2007-0043974, filed on Jul. 5, 2007, all of which are herein incorporated by reference in their entireties.

BACKGROUND OF THE INVENTION

1. Field of the Invention

The present invention relates generally to a dust separator of a vacuum cleaner, and, more particularly, to a dust separator of a vacuum cleaner having a body including an air inlet formed in the body configured to receive an air flow containing dust, and a dust outlet formed to discharge dust separated in the body.

2. Description of Related Art

In general, a vacuum cleaner is an apparatus that uses suctioning force imparted by a suction motor installed in a main body to suction air including dust and filter the dust within the main body. Such vacuum cleaners can largely be divided into canister vacuum cleaners that have a suctioning nozzle provided separately from and connected with a main body, and upright vacuum cleaners that have a suctioning nozzle coupled to the main body.

A related art vacuum cleaner includes a vacuum cleaner main body, and a dust separator installed in the vacuum cleaner main body for separating dust from air. The dust separator is generally configured to separate dust using a cyclone principle. Because performance of this these vacuum cleaners can be rated based on the fluctuating range of their dust separating performance, dust separators for vacuum cleaners have continuously been developed to provide improved dust separating performance.

Also, from a user's perspective, dust separators for vacuum cleaners that can be easily separated from the vacuum cleaner main body, and that enable dust to easily be emptied, are desired.

BRIEF SUMMARY OF THE INVENTION

An object of the present invention is to provide a dust separator of a vacuum cleaner with improved dust separating performance.

Another object of the present invention is to provide a dust separator of a vacuum cleaner having a dust container with a simplified configuration to allow a user to easily empty dust.

A further object of the present invention is to provide a dust separator of a vacuum cleaner that allows a user to use minimal exertion to handle a dust container.

According to one aspect of the present invention, a dust separator for a vacuum cleaner including a body having a pair of spaced apart ends, a first air inlet formed in the body and being configured to receive an air flow containing dust, and a dust outlet formed inwardly of the spaced apart ends and apart from the first air inlet to discharge dust separated in the body, is provided. In addition, a cross-sectional area of the body at the dust outlet is greater than a cross-sectional area of the body at the first air inlet.

In accordance with another aspect of the present invention, a dust separator for a vacuum cleaner including a body having a first air inlet formed therein, the first air inlet being configured to receive an airflow containing dust, a first air outlet, and a dust outlet to discharge dust separated in the body, is provided. In addition, a cross-sectional area of the dust separator at the dust outlet is greater than a cross-sectional area of the dust separator at the first air outlet.

In accordance with another aspect of the present invention, a vacuum cleaner is also provided. The vacuum cleaner includes a dust separator as described above, a dust container to collect dust discharged through the dust outlet, and a suction motor in communication with the dust separator.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from the detailed description.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DETAILED DESCRIPTION OF THE INVENTION

Below, detailed descriptions of exemplary embodiments of the present invention will be provided with reference to the drawings.

Figure 1:
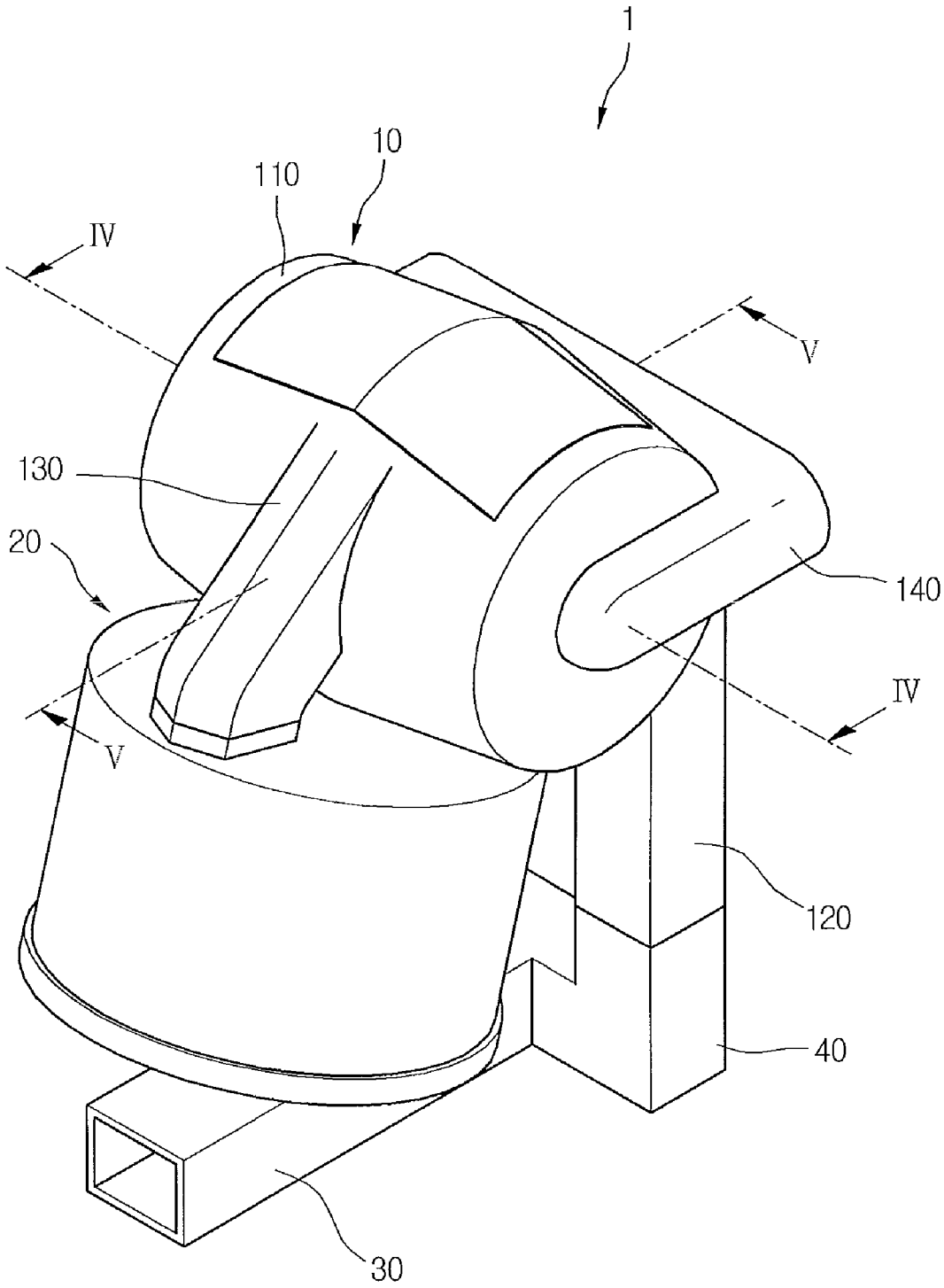
FIG. 1 is a front perspective view of a dust separator of a vacuum cleaner according to a first exemplary embodiment of the present disclosure.
Figure 2:
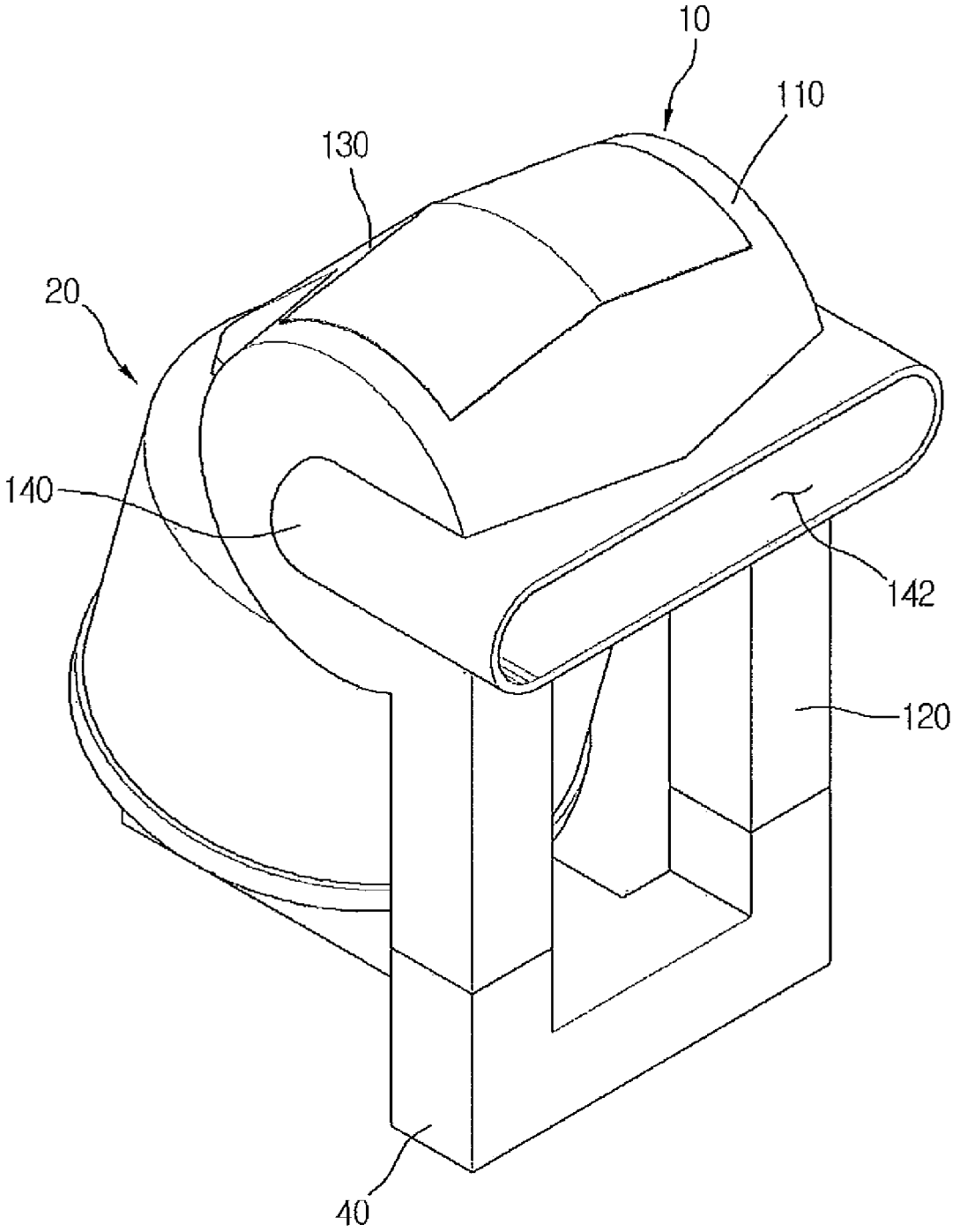
FIG. 2 is a rear perspective view of the dust separator of FIG. 1.
Figure 3:
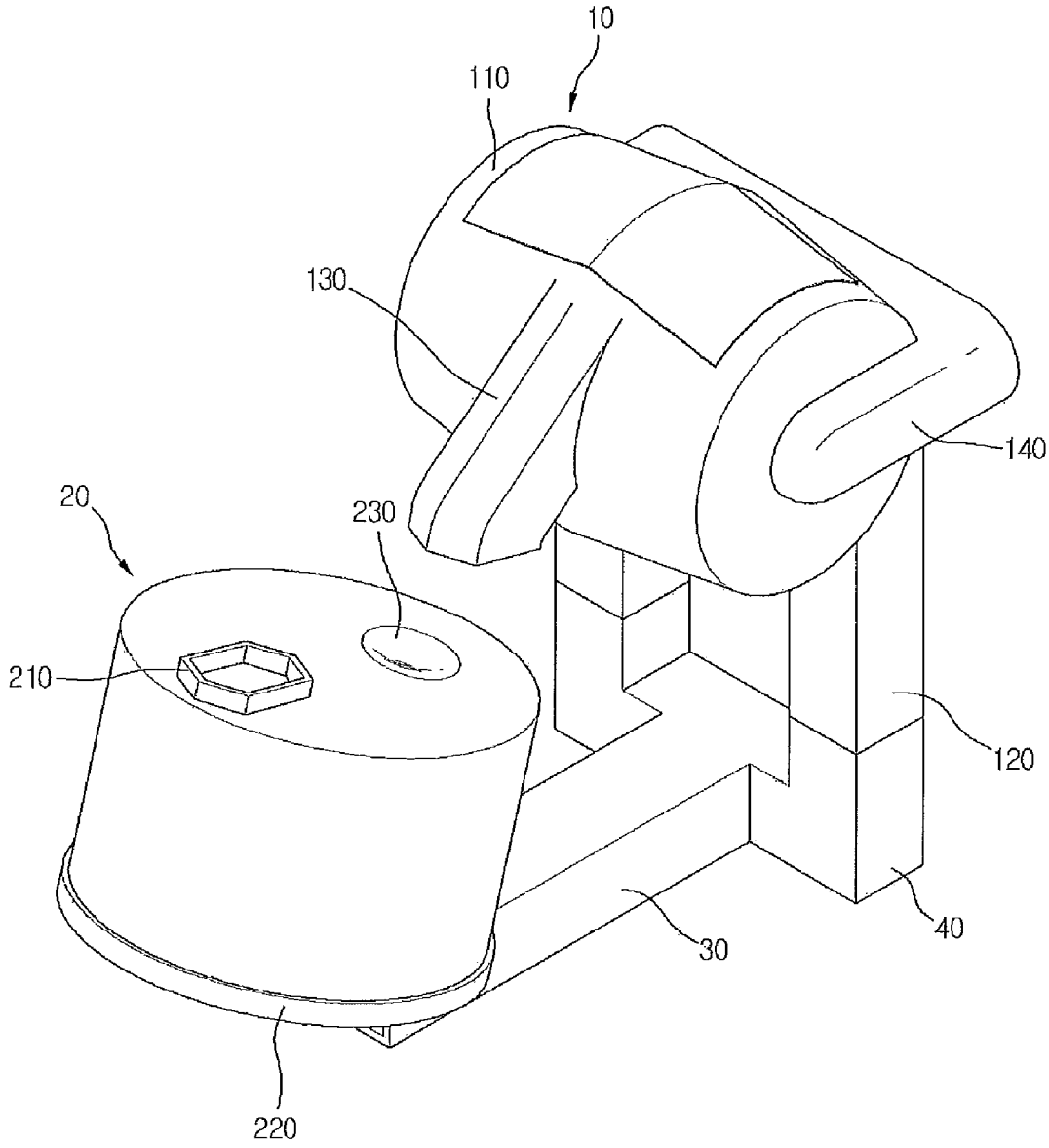
FIG. 3 is a disassembled perspective view of the dust separator of FIG. 1.

Referring to FIGS. 1 to 3, a dust separator 1 of a vacuum cleaner according to a first exemplary embodiment of the present invention includes a dust separating unit 10 that separates dust from suctioned air, a dust container 20 for storing dust separated by the dust separating unit 10, a suctioning guide 30 that guides the flow of air including dust toward the dust separating unit 10, and a distribution unit 40 for distributing the air in the suctioning guide 30 to the dust separating unit 10.

In detail, air suctioned through a suctioning nozzle (not shown) flows to the suctioning guide 30. The suctioning guide 30 is provided inside the vacuum cleaner, and is disposed below the dust container 20. The suctioning guide 30 has the distribution unit 40 connected thereto. The dust separating unit 10 separates dust from air supplied from the distribution unit 40. The dust separating unit 10 uses the cyclone principle to separate dust from air, and includes a cyclone 110 for this purpose. The cyclone 110 is formed to have a diameter greater at its middle than at either end thereof. The axis of the cyclone 110 extends in a horizontal direction. Thus, the air within the cyclone 110 rotates in a vertical direction.

A pair of air inlets 120 is formed (one on either side) at the cyclone 110 and are arranged to suction air. The pair of air inlets 120 may be formed in tangential directions with respect to the cyclone 110 in order to generate cyclone airflows within the cyclone 110. The pair of air inlets 120 provides suctioning passages for air entering the cyclone 110. Each air inlet 120 is connected at opposite sides of the distribution unit 40. Therefore, the air that flows through the suctioning guide 30 is branched at either side at the distribution unit 40, and the branched air rises along the respective air inlets 120 to be suctioned into the cyclone 110.

A dust outlet 130 that exhausts dust separated within the cyclone 110 is formed at the center of the cyclone 110.

Accordingly, the dust separated from air suctioned through each air inlet 120 at either side of the cyclone 110 moves to the center of the cyclone 110. Next, the dust that flows to the center of the cyclone passes through the dust outlet 130 and is discharged to the dust container 20. In this first exemplary embodiment, the dust outlet 130 is formed tangentially with respect to the cyclone 110 to allow easy discharging of dust. Thus, the dust separated in the cyclone 110 is discharged tangentially with respect to the cyclone 110—that is, in the same direction in which the dust has been rotating—allowing easy discharging of not only dust with higher density, but also easy discharging of dust with lower density from the cyclone 110. Because dust with lower density can easily be discharged, less dust with lower density will accumulate on a filter member (to be described below), thereby facilitating flow of air and improving dust separating performance.

Also, air outlets 140 are formed on opposite sides of the cyclone 110 and are configured to discharge air separated from dust in the cyclone 110. The air discharged through the air outlets 140 converges at a converging passage 142 and enters the main body of the vacuum cleaner (not shown).

The dust container 20 stores dust separated in the dust separating unit 10. Because the dust container 20 is installed on the vacuum cleaner main body, the dust container 20 communicates with the dust separating unit 10. Specifically, when the dust container 20 is installed on the vacuum cleaner main body, the dust container 20 is disposed below the dust separating unit 10. Thus, a dust inlet 210 is formed in the upper side of the dust container 20. Also, the dust outlet 130 extends downward from the cyclone 110 toward the dust inlet 210. Accordingly, the dust separated in the cyclone 110 moves downward along the dust outlet 130, and the separated dust can easily enter the dust container 20.

A cover member 220 is coupled at the bottom of the dust container 20 to discharge dust stored within. The cover member 220 may be pivotably coupled to the dust container 20, and may be detachably coupled thereto, as well. The coupling method of the cover member 220 in the first exemplary embodiment is not restricted to any particular methods. Thus, the dust container 20 is provided as a separate component to the dust separating unit 10, and is configured to be selectively communicable with the dust separating unit 10. Accordingly, a user can separate only the dust container 20 from the vacuum cleaner main body to empty dust stored in the dust container 20.

Because a structure for separating dust within the dust container 20 is not provided, the structure of the dust container 20 is simplified and the weight of the dust container 20 can be minimized. By minimizing the weight of the dust container 20, a user can easily carry and handle the dust container 20, and because the internal structure of the dust container 20 is simple, dust can easily be emptied, and a user can easily clean the inside of the dust container 20.

Figure 4:
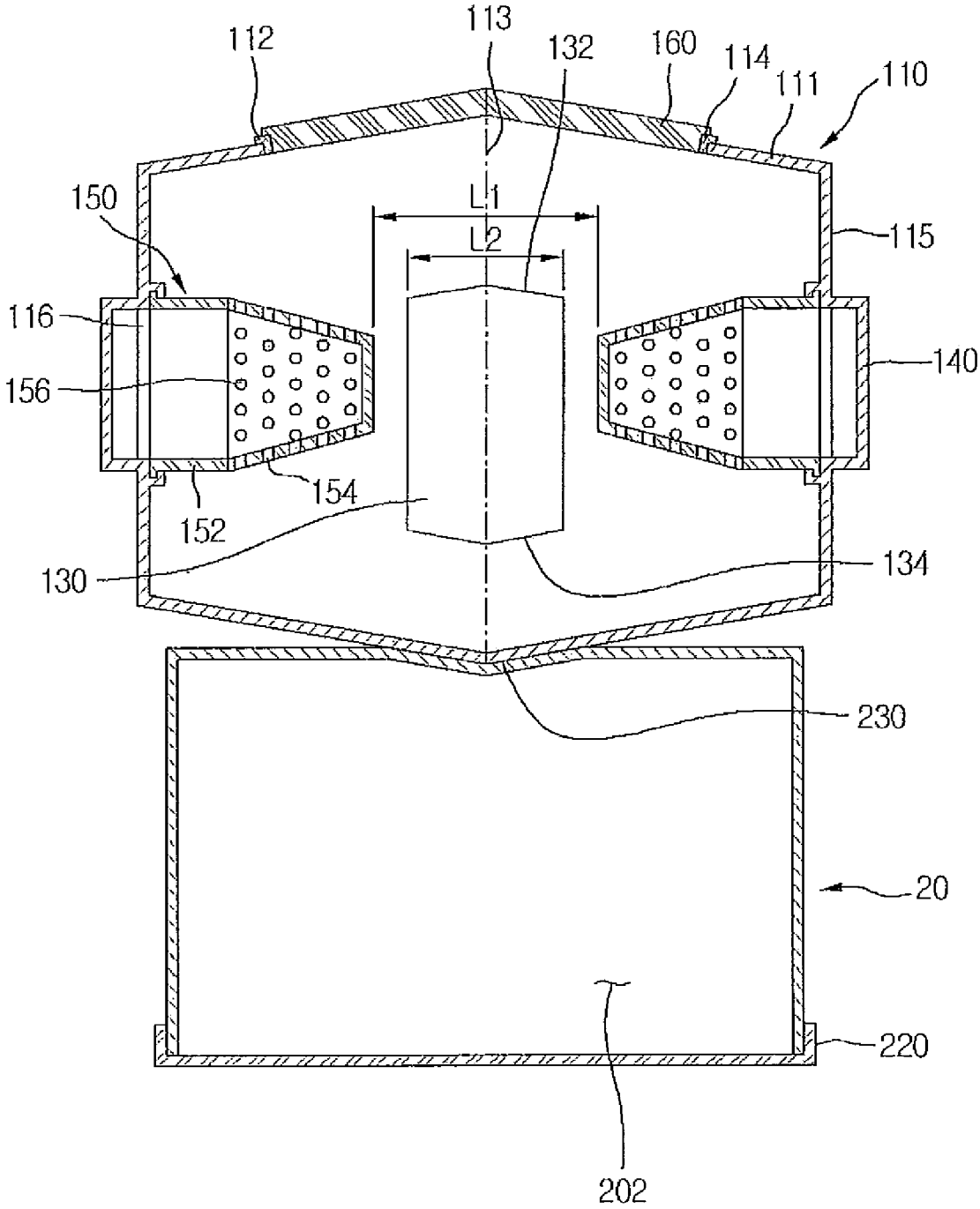
FIG. 4 is a sectional view taken along line IV-IV of FIG. 1.
Figure 5:
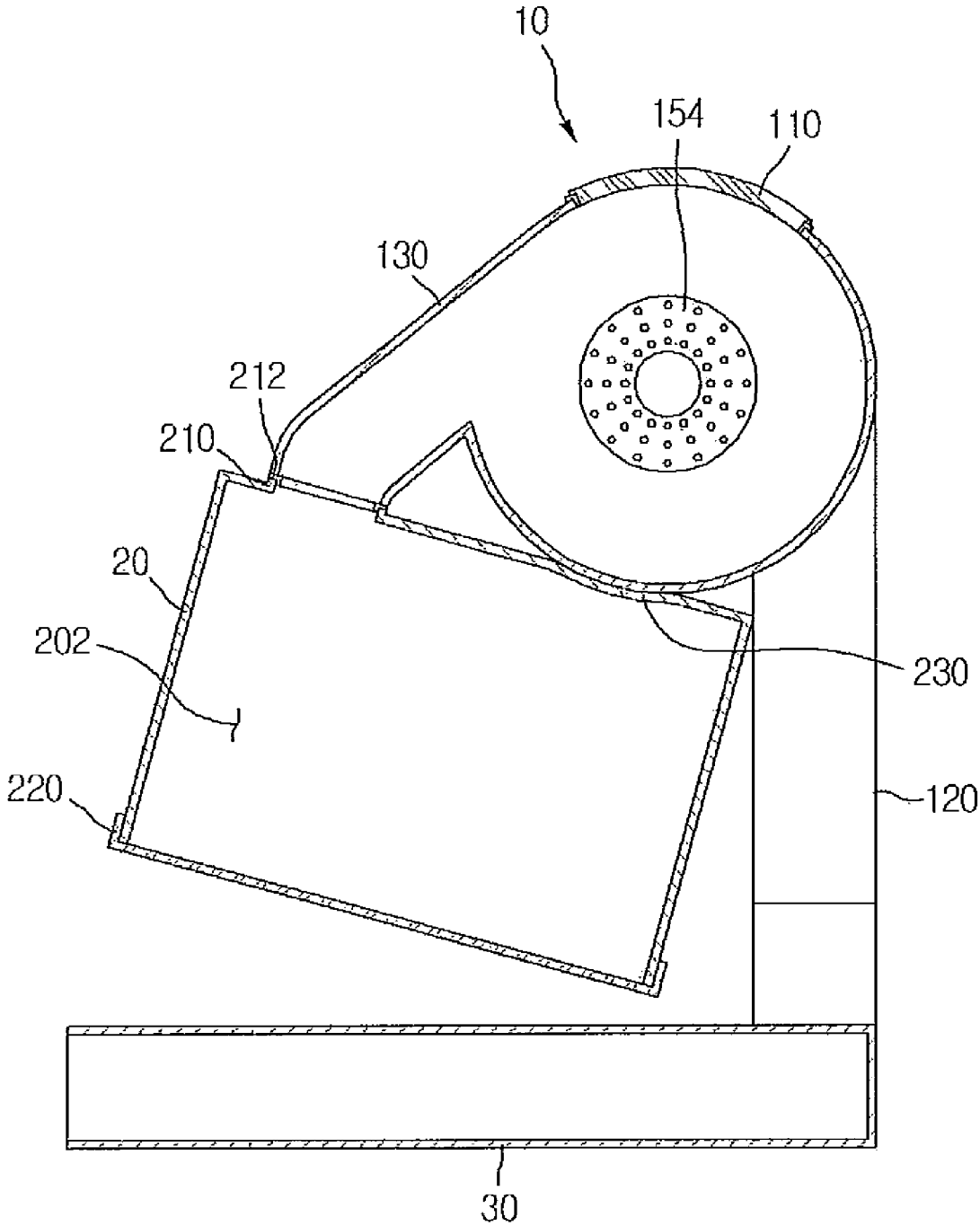
FIG. 5 is a sectional view taken along line V-V of FIG. 1.

Having described the dust separator 1 according to the first exemplary embodiment generally, a more specific description is provided with reference to FIGS. 4 and 5. Referring to FIGS. 4 and 5, the cyclone 110 includes a body 111 for generating cyclone airflow, and a pair of sides 115, each constituting opposite sides of the body 111. The sides 115 extend parallel to one another.

An air inlet 120 is formed on opposite side of the body 111, respectively. Each air inlet 120 is formed tangentially with respect to the cyclone 110. Thus, the air suctioned through each air inlet 120 forms one of two cyclone airflows within the cyclone 110 and the cyclone airflows circulate along the inner surface of the body 111. Thus, when a pair of cyclone airflows is generated within a single space, the flow volume of air is increased, loss of airflow is reduced, and separating performance can be improved and the cyclone can be formed smaller than with a single cyclone airflow generated in a single space.

In this first exemplary embodiment, even if the cyclone 110 is formed smaller than in the related art, the centrifugal force generated at the air inlets 120 is greater than in the related art, thus improving dust separating performance. Also, when a pair of cyclone airflows is generated in a single space, the same level of dust separating performance as in a structure where air passes through a plurality of dust separating units can be realized. Thus, additional dust separating units for separating dust from air discharged from the dust separating unit are not required. However, additional dust separating units incorporating features of this first exemplary embodiment may be provided.

Furthermore, when a pair of cyclone airflows is generated with one at either side of the cyclone 110 and the cyclone airflows flow toward the center, the cyclone airflow at the center increases. Therefore, a stronger cyclone airflow is generated at the center of the cyclone 110 than at the sides of the air inlets 120. As a result, when the pair of cyclone airflows converges at the center of the cyclone 110, the strength of the airflow is greater than in the case where a single cyclone airflow is generated in a single space, thereby increasing dust separating performance.

Dust that moves to the center of the cyclone 110 can be discharged through the dust outlet 130 to the dust container 20 by means of the strong cyclone airflow, so that dust discharging performance can be increased. In addition, hair and other impurities that normally would adhere to the entrance or the inside of the dust outlet 130 because of static electricity do not adhere to the dust outlet 130 and are easily discharged to the dust container 20 because of the strong cyclone airflow generated at the dust outlet 130.

In this first exemplary embodiment, the cyclone 110 is formed so that its diameter increases from either side toward the center. Accordingly, the greatest diameter of the cyclone 110 is at its center 113. Thus, because the cyclone 110 is formed to have a diameter that increases toward its center, a pair of cyclone airflows that is generated at either end of the cyclone 110, respectively, can easily flow toward the center and converge. The cyclone airflows generated within the cyclone 110 move toward the center and converge, and the cyclone airflows that converge at the center of the cyclone move laterally at the center. Accordingly, in this first exemplary embodiment, the region of the cyclone 110 with the greatest diameter is at the center 113 in order to allow easy convergence of the respective cyclone airflows at the center 113 and prevent lateral movement. In particular, because the diameter at the center of the cyclone 110 is greater than at either side, the velocity of cyclone airflow at the center of the cyclone 110 decreases, thereby reducing the formation of eddies at the center of the cyclone 110.

The upper and lower perimeters 132 and 134 of the dust outlet 130 may form angles corresponding to the tilted angles of the cyclone 110.

When the diameter at the center of the cyclone 110 is greater than at either side, the center of the cyclone 110 may be configured to be mounted above the dust container 20. Therefore, the dust container 230 may include a mounting recess 230 to mount the central portion of the cyclone 110 on.

An outlet 116 is formed to pass through each side 115 to discharge air from which dust is separated in the cyclone 110. Also, a filter member 150 is coupled to each outlet 116 to filter the discharged air. In particular, the filter member 150 is configured with a cylindrical fastener 152 fastened to the inside of the cyclone 110, and a conical filter 154 extending from the fastener 152 to filter air. Also, a plurality of holes 156 is formed in the filter 154 for air to pass through. Accordingly, air separated from dust in the cyclone 110 passes through the plurality of holes 156 and is discharged from the cyclone 110 through the outlets 116.

In this first exemplary embodiment, the fastener 152 does not have through-holes formed therein so that air suctioned through the air inlet 120 is not immediately discharged, but is able to smoothly circulate within the cyclone 110. That is, because of the fasteners 152, the circulation of suctioned air can be guided to generate a smooth cyclone airflow within the cyclone 110, thereby increasing dust separating performance.

As seen in FIG. 4, a length (L1) between the pair of filter members 150 provided within the cyclone may be made greater than a width (L2) of the dust outlet 130. In this first exemplary embodiment, when the length (L1) between the pair of filter members 150 is made smaller than the width (L2) of the dust outlet 130, impurities such as hair and tissue paper are not discharged through the dust outlet 130, and can adhere to the filter member 150 or lodge inside the holes 156. As a result, the air cannot easily pass through the filter member 150, causing a reduction in suctioning force. Accordingly, the length (L1) between the pair of filter members 150 is made greater than the width (L2) of the dust outlet 130 so that impurities such as hair and tissue paper can be completely discharged through the dust outlet 130.

As described above in this first exemplary embodiment, air is suctioned through the plurality of air inlets 120 into the cyclone 110, and air separated from dust in the cyclone 110 is discharged from the cyclone 110 through the plurality of outlets 116. Thus, air that is suctioned into the cyclone 110 through the respective air inlets 120 is discharged through the respective outlets 116 to allow easy discharging of air. When air is thus easily discharged from the cyclone 110, suctioning force is actually increased, and cyclone airflow within the cyclone 110 is smoothly performed. Also, even when dust collects on one of the filter members 150 so that air cannot flow easily therethrough, air can be discharged through the other filter member 150, thereby preventing a sudden loss of air suctioning force.

An opening 112 is formed on the body 111 of the cyclone 110 to allow replacing and cleaning of the filter member 150. The opening 112 is opened and closed by means of a cover member 160. A sealing member 114 is provided at the coupling region of the opening 112 and the cover member 160. In this first exemplary embodiment, the inner surface of the cover member 160 may be formed to have the same curvature as the inner periphery of the body 111 when the cover member 160 is coupled to the body 111. Accordingly, changes to the cyclone airflow due to the cover member 160 within the cyclone 110 can be prevented, and the cyclone airflow can be uniformly maintained. Also, because the cover member 160 is detachably coupled to the cyclone 110, a user can detach the cover member 160 to easily replace the filter members 150 and easily clean the inside of the cyclone 110 and the filter members 150.

A dust compartment 202 for storing dust is defined within the dust container 20, and a dust inlet 210 is defined in the top of the dust container 20. Also, a sealing member 212, for sealing the contacting region between the dust inlet 210 and the dust outlet 130, is provided on the dust inlet 210. Here, the sealing member 212 may also be provided on the dust outlet 130.

Figure 6:
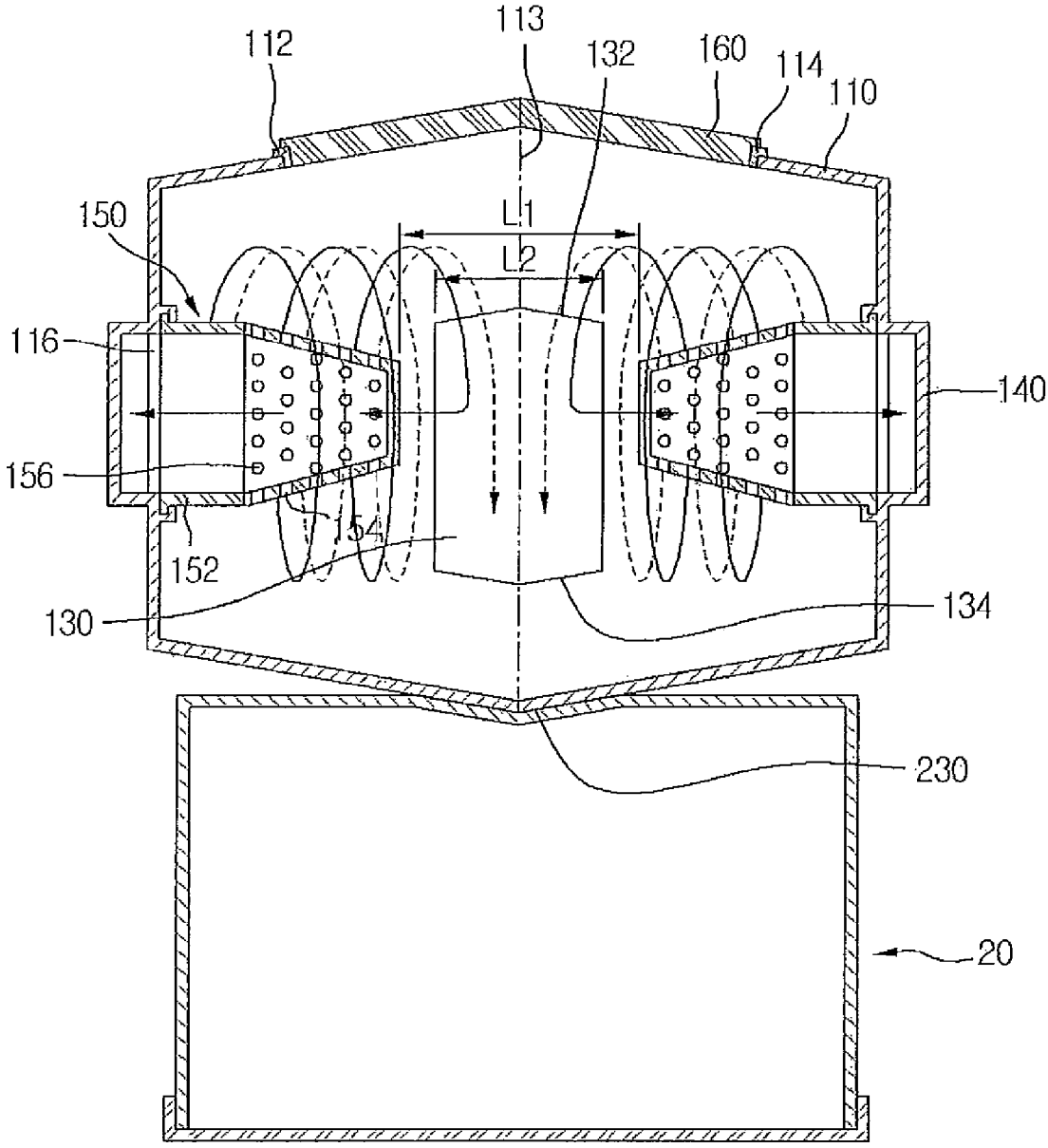
FIG. 6 is a schematic view similar to FIG. 4 showing airflow within the dust separator of FIG. 1.
Figure 7:
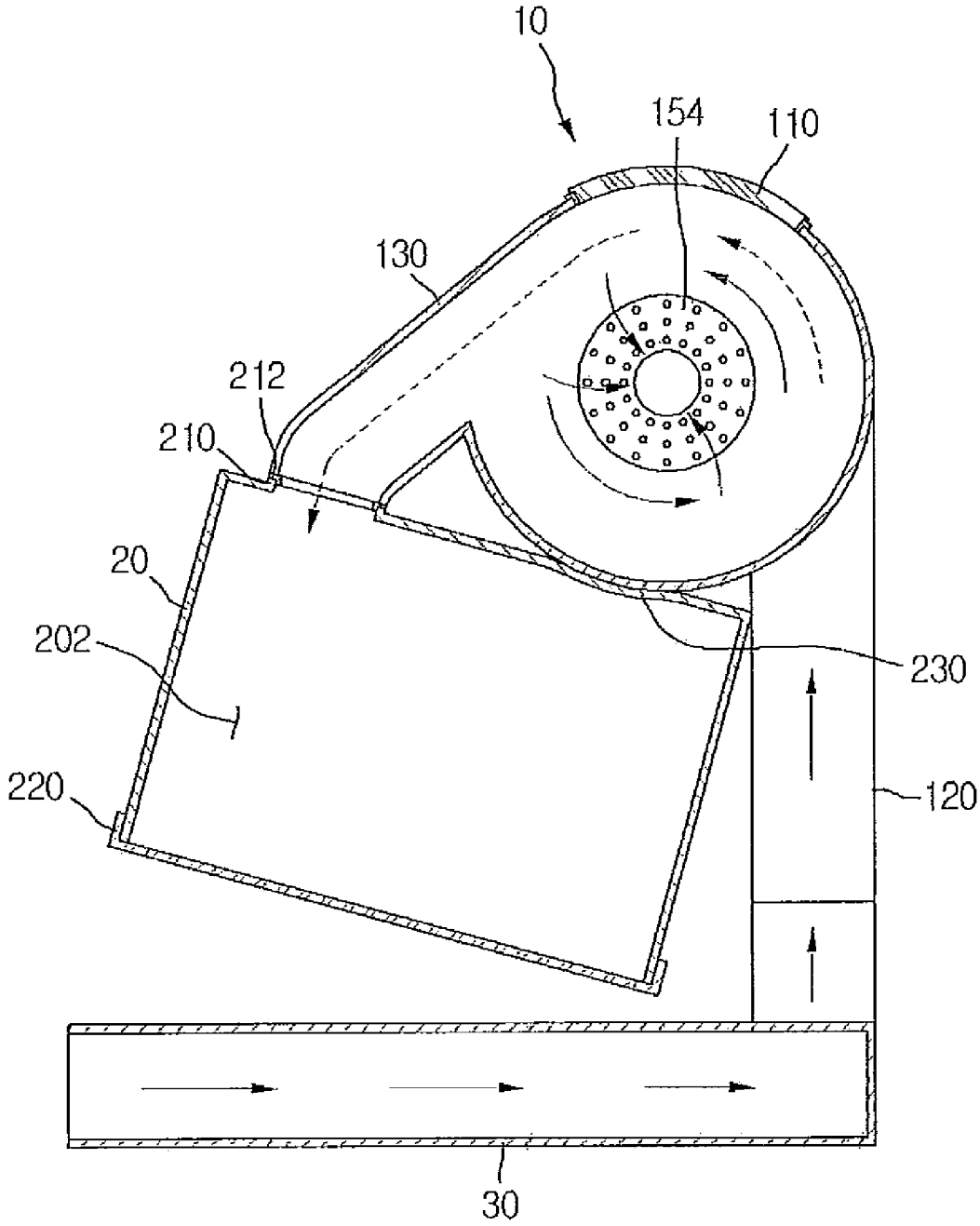
FIG. 7 is a schematic view similar to FIG. 5 showing airflow within the dust separator of FIG. 1.

The operation of the dust separator 1 will be described with reference to FIGS. 6 and 7. When suctioning force is generated by the vacuum cleaner, air including dust flows along the suctioning guide 30. The air flowing through the suctioning guide 30 flows to the distribution unit 40 and is distributed to each air inlet 120 by the distribution unit 40. Then, the air, including dust, passes through each air inlet 120 and is suctioned in tangential directions at either side of the cyclone 110.

The suctioned air rotates along the inner surface of the cyclone 110 to move toward and converge at the center of the cyclone 110. During this process, air and dust are subjected to different centrifugal forces due to their differences in weight, so that dust is separated from the air. The separated dust (represented by the broken lines) is discharged from the center of the cyclone 110 through the dust outlet 130, and the discharged dust flows through the dust outlets 130 and into the dust container 20. Conversely, air (represented by the solid lines) separated from dust is filtered by the filter members 150, and then passes through the outlets 116 and is discharged from the cyclone 110. The discharged air flows through the respective air outlets 140, converges at the converging passage 142, and enters the main body of the vacuum cleaner.

Having described a dust separator for a vacuum cleaner according to a first exemplary embodiment above, a dust separator for a vacuum cleaner according to a second exemplary embodiment will be described with reference to FIGS. 8 and 9. The second exemplary embodiment is the same as the first exemplary embodiment in all other aspects except that it is characterized by a difference in the shape of the cyclone. Therefore, description will be provided of only the different portions of the second exemplary embodiment.

Figure 8:
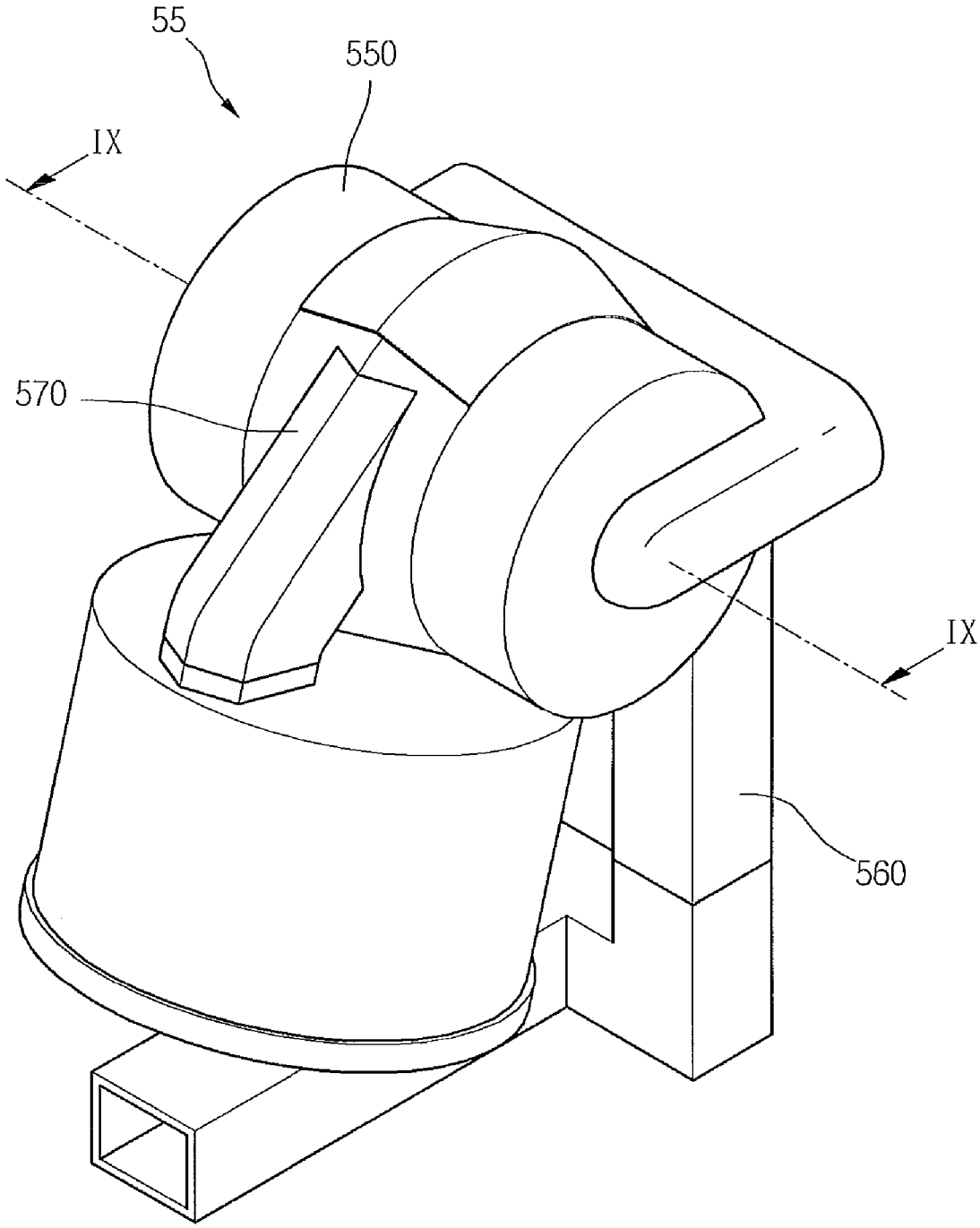
FIG. 8 is a perspective view of a dust separator according to a second exemplary embodiment of the present disclosure.
Figure 9:
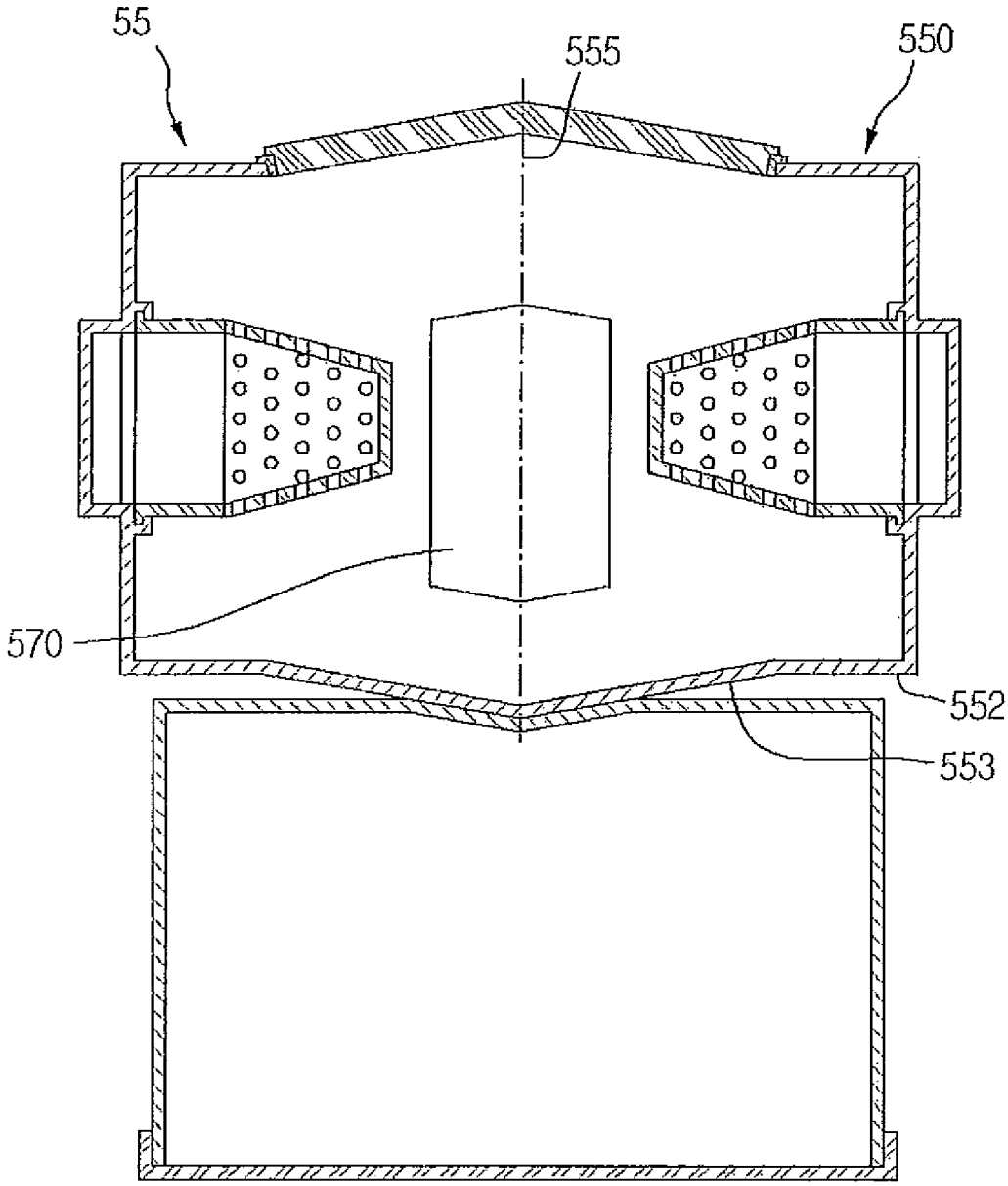
FIG. 9 is a sectional view taken along line IX-IX of FIG. 8.

As shown in FIGS. 8 and 9, a dust separator 55 a cyclone 550 having a diameter greater at the center than at either end thereof. In particular, the cyclone 550 includes a cylindrical portion 552 with substantially constant diameter for a predetermined distance toward a center 555 from either end, and an oblique portion 553 extending from the cylindrical portion 552 and increasing in diameter toward the center 555. The cyclone 550 is formed symmetrically to the left and right of the center 555. A dust outlet 570 through which dust is discharged is formed in the oblique portion 553. Accordingly, cyclone airflows generated in the cylindrical portions 552 move toward the oblique portions 553 and converge at the center 555 of the cyclone, and are prevented from moving laterally further by the center 555.

Figure 10:
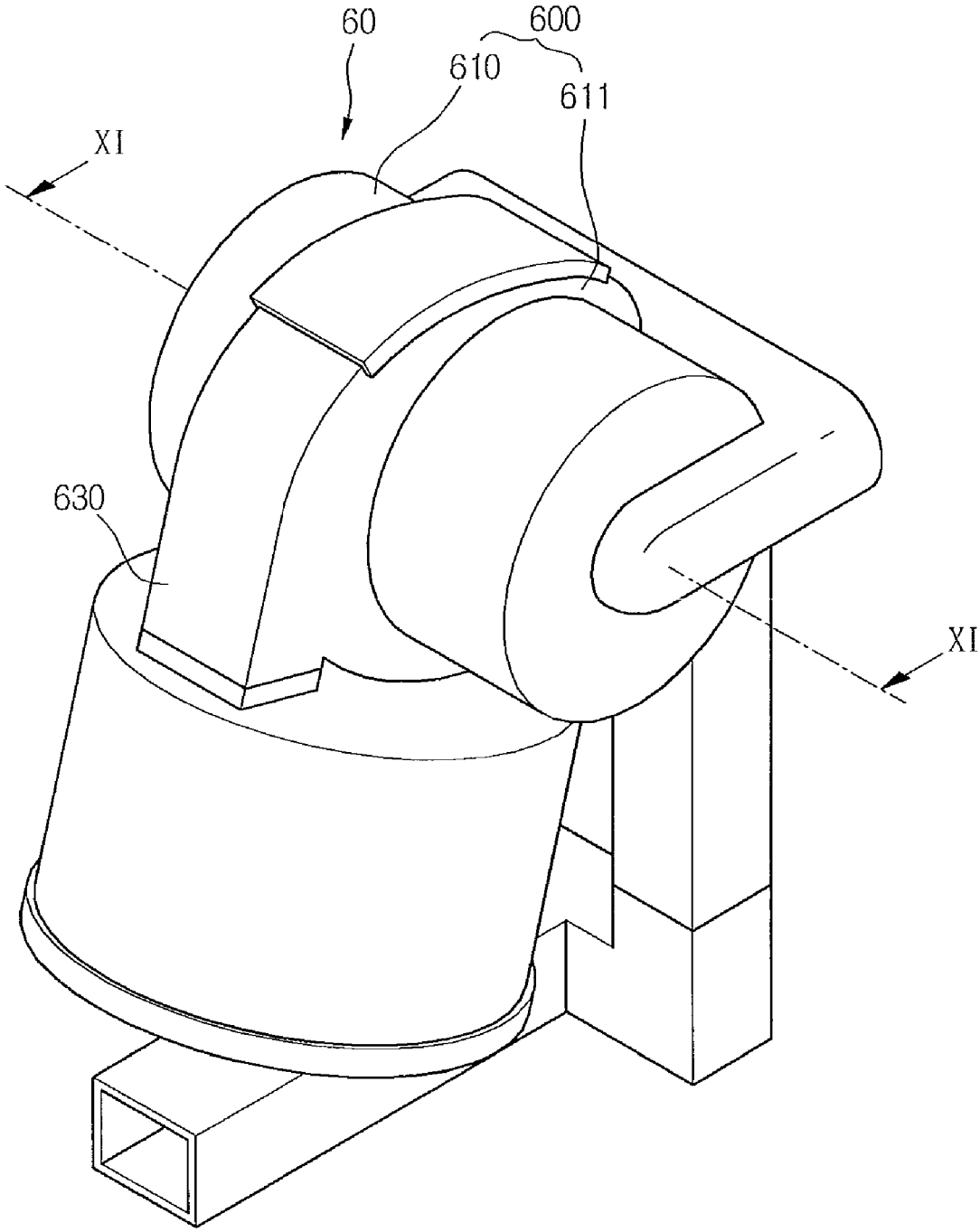
FIG. 10 is a perspective view of a dust separator according to a third exemplary embodiment of the present disclosure.
Figure 11:
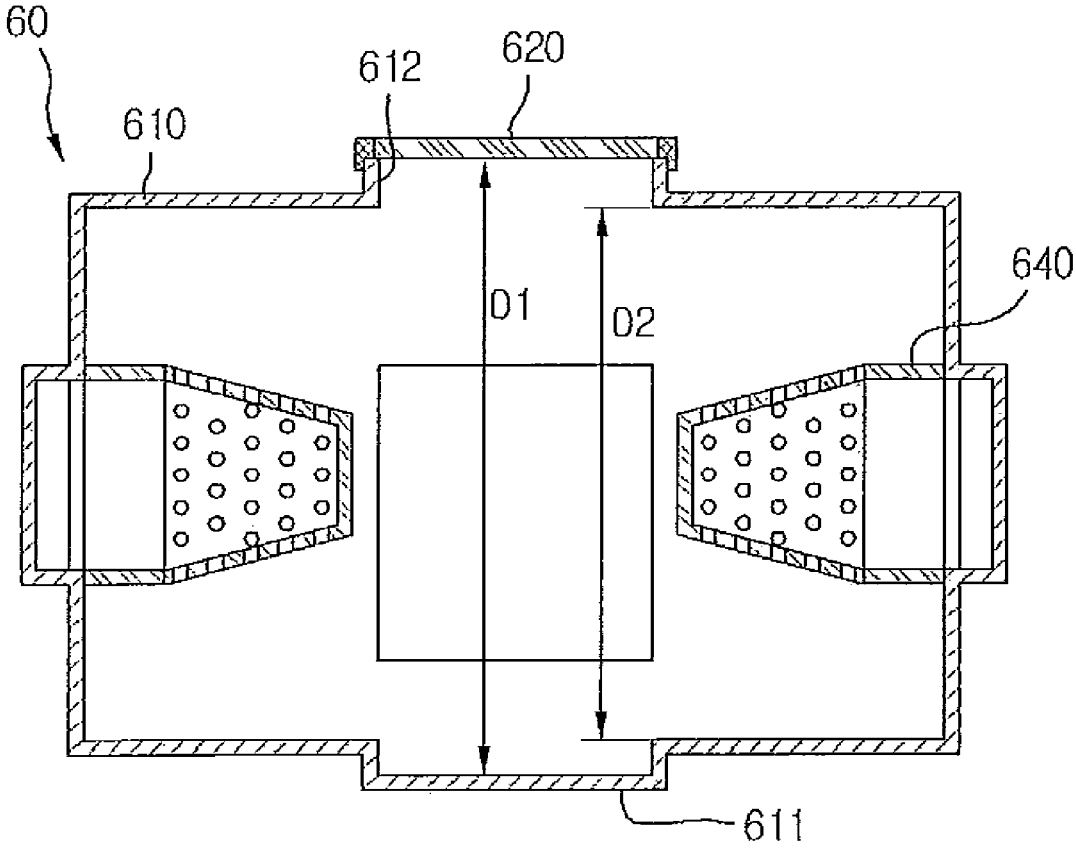
FIG. 11 is a sectional view taken along line XI-XI of FIG. 10.

A dust separator for a vacuum cleaner according to a third exemplary embodiment of the present invention is shown in FIGS. 10 and 11. The third exemplary embodiment is the same as the first exemplary embodiment in all other aspects except that it is characterized by a difference in the shape of the cyclone. Therefore, description will be provided of only the different portions of the third exemplary embodiment.

Referring to FIGS. 10 and 11, a dust separating unit 60 according to the third exemplary embodiment includes a cyclone 600 with a diameter greater at the center than at either end thereof. The cyclone 600 includes a pair of cylindrical portions 610, and an expanded portion 611 formed between the cylindrical portions 610 and having a diameter (D2) greater than a diameter (D1) of the cylindrical portions 610. The expanded portion 611 is also cylindrical. The cyclone 600 is symmetrical to the left and right of the expanded portion 611. A dust outlet 630, for discharging dust separated in the cyclone, is formed in the expanded portion 611. In this exemplary embodiment, the width of the expanded portion 611 and the width of the dust outlet 630 may be equal, or the width of the dust outlet 630 may be less than the width of the expanded portion.

The pair of cyclone airflows generated in the cyclone 600 moves in mutually convergent directions, for example, toward the expanded portion 611, and combine together. In addition, the expanded portion 611 confines the lateral movement of the cyclone airflows therein to maintain stable cyclone airflow. Also, because the diameter (D1) of the expanded portion 611 is greater than the diameter (D2) of the cylindrical portions 610, dust that moves to the expanded portion 611 is prevented from moving toward the filter members 640.

An opening 612 is defined in the expanded portion 611. The opening 612 is opened and closed by means of a cover member 620 coupled to the expanded portion 611. Therefore, when a user separates the cover member 620, the inside of the cyclone 600 and the filter members 640 can be cleaned.

Having described several exemplary embodiments of the present invention, one or more of these embodiments may provide various advantages over the related art dust separators. For example, because a plurality of air inlets is formed in a dust separator, and a plurality of cyclone airflows is formed within the dust separator, the airflow volume is increased and airflow loss is reduced, thereby improving dust separating performance.

Also, because air inlets are formed at either side of the dust separator, and a dust outlet is formed in the center of the dust separator, a forceful cyclone airflow is generated at the central portion of the dust separator to allow dust to be easily discharged.

Because the diameter at the center of the dust separator is greater than those at either end thereof, the center of the dust separator becomes the center of airflow, thereby ensuring reliable airflow. That is, the formation of eddies at the central portion of the dust separator can be reduced. In addition, cyclone airflows can easily converge at the center of the dust separator.

Furthermore, because a dust outlet is formed tangentially to the dust separator, the dust can be discharged in the same direction in which it has been rotating. Thus, not only can dust of higher density be easily discharged, dust of lower density can also be discharged easily from the dust separator.

Because a cover member is detachably coupled to the dust separator, a user can easily clean the inside of the dust separator and the filter member.

The invention thus being described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A dust separator for a vacuum cleaner, the dust separator comprising:

a body having a pair of spaced apart ends, first and second air inlets formed in the body and being configured to receive an air flow containing dust, a dust outlet formed inwardly of the spaced apart ends and apart from the first air inlet to discharge dust separated in the body, air outlets formed in the body and being configured to discharge air, and a converging passage at which the air discharged through the air outlets converges, wherein a cross-sectional area of the body at the dust outlet is greater than a cross-sectional area of the body at the first air inlet, and the dust outlet includes at least one oblique portion.

2. The dust separator of claim 1, wherein the dust outlet is located in a center portion of the body.

3. The dust separator of claim 1, further comprising a second air inlet formed in the body and being configured to receive the air flow containing dust.

4. The dust separator of claim 3, wherein the first air inlet is formed in one end of the pair of spaced apart ends and the second air inlet is formed in the other end of the pair of spaced apart ends.

5. The dust separator of claim 3, wherein the body includes:

a pair of cylindrical portions; and an expanded portion located between the pair of cylindrical portions, wherein the first air inlet is formed in one of the cylindrical portions, the second air inlet is formed in the other of the cylindrical portions, and the dust outlet is formed in the expanded portion.

6. The dust separator of claim 5, wherein a width of the expanded portion is the same as a width of the dust outlet.

7. The dust separator of claim 1, wherein the body includes:

a pair of cylindrical portions; and an expanded portion located between the pair of cylindrical portions, wherein the first air inlet is formed in one of the cylindrical portions, and the dust outlet is formed in the expanded portion.

8. The dust separator of claim 1, wherein the body includes:

a cylindrical portion; and an oblique portion, wherein the first air inlet is formed in the cylindrical portion, and the dust outlet is formed in the oblique portion.

9. The dust separator of claim 1, wherein the body has a cross-sectional area that progressively increases from the first air inlet toward the dust outlet.

10. A vacuum cleaner comprising:

a dust separator, the dust separator including:

a body having a pair of spaced apart ends, first and second air inlets formed in the body and being configured to receive an air flow containing dust, a dust outlet formed inwardly of the spaced apart ends and apart from the first air inlet to discharge dust separated in the body, air outlets formed in the body and being configured to discharge air, and a converging passage at which the air discharged through the air outlets converges, wherein a cross-sectional area of the body at the dust outlet is greater than a cross-sectional area of the body at the air inlet, and wherein the dust outlet includes at least one oblique portion;

a dust container to collect dust discharged through the dust outlet; and a suction motor in communication with the dust separator.

11. The vacuum cleaner of claim 10, wherein the dust outlet is located in a center portion of the body.

12. The vacuum cleaner of claim 10, further comprising a second air inlet formed in the body and being configured to receive the air flow containing dust.

13. The vacuum cleaner of claim 12, wherein the first air inlet is formed in one end of the pair of spaced apart ends and the second air inlet is formed in the other end of the pair of spaced apart ends.

14. The vacuum cleaner of claim 12, wherein the body includes:

a pair of cylindrical portions; and an expanded portion located between the pair of cylindrical portions, wherein the first air inlet is formed in one of the cylindrical portions, the second air inlet is formed in the other of the cylindrical portions, and the dust outlet is formed in the expanded portion.

15. The vacuum cleaner of claim 10, wherein the body includes:

a pair of cylindrical portions; and an expanded portion located between the pair of cylindrical portions, wherein the first air inlet is formed in one of the cylindrical portions, and the dust outlet is formed in the expanded portion.

16. A dust separator for a vacuum cleaner, the dust separator comprising:

a body having a pair of cylindrical portions, an oblique portion between the pair of cylindrical portions, first and second air inlets formed in the pair of cylindrical portions and the first and second air inlets being configured to receive an airflow containing dust, a dust outlet formed in the oblique portion to discharge dust separated in the body, and first and second air outlets formed in the pair of cylindrical portions, wherein a cross-sectional area of the oblique portion is greater than a cross-sectional area of each cylindrical portion.

17. The dust separator of claim 16, wherein the body includes:

a pair of spaced apart ends, wherein the first air outlet is formed in one end of the pair of spaced apart ends and the second air outlet is formed in the other end of the pair of spaced apart ends.

18. A vacuum cleaner comprising:

a dust separator, the dust separator including:

a body having a first air inlet formed therein, the first air inlet being configured to receive an airflow containing dust, a first air outlet, and a dust outlet to discharge dust separated in the body, wherein a cross-sectional area of the dust separator at the dust outlet is greater than a cross-sectional area of the dust separator at the first air outlet;

a dust container to collect dust discharged through the dust outlet; and a suction motor in communication with the first air outlet, wherein the body includes:

a pair of cylindrical portions;

a second air inlet;

a second air outlet; and an expanded portion located between the pair of cylindrical portions, wherein the first air outlet and the first air inlet are formed in one of the cylindrical portions, the second air outlet and the second air inlet are formed in the other of the cylindrical portions, and the dust outlet is formed in the expanded portion.

19. The vacuum cleaner of claim 18, wherein the body includes a pair of spaced apart ends, wherein the first air outlet is formed in one end of the pair of spaced apart ends and the second air outlet is formed in the other end of the pair of spaced apart ends.

20. The vacuum cleaner of claim 19, further comprising a second air inlet formed therein, wherein the first air inlet is formed in said one end of the pair of spaced apart ends and the second air inlet is formed in said other end of the pair of spaced apart ends.

21. The vacuum cleaner of claim 18, wherein a width of the expanded portion is the same as a width of the dust outlet.

22. The vacuum cleaner of claim 18, further comprising a second air inlet formed in the body, wherein the first air inlet is formed in said one of the cylindrical portions and the second air inlet is formed in said other of the cylindrical portions.

* * * * *